United States Patent [19]

Müller

[11] 4,358,100

[45] Nov. 9, 1982

[54] APPARATUS FOR SINGULARIZING STACKED SHEETS

[75] Inventor: Hans Müller, Zofingen, Switzerland

[73] Assignee: Grapha-Holding AG, Hergiswil, Switzerland

[21] Appl. No.: 192,445

[22] Filed: Sep. 30, 1980

[30] Foreign Application Priority Data

Oct. 17, 1979 [CH] Switzerland ..... 9325/79

[51] Int. Cl.[3] ..... B65H 5/08

[52] U.S. Cl. ..... 271/11; 271/100; 271/277; 101/409

[58] Field of Search ..... 271/277, 82, 5, 11, 271/12, 100, 106, 107; 101/408, 409, 410, 411

[56] References Cited

U.S. PATENT DOCUMENTS

| | | | |
|---|---|---|---|
| 2,827,287 | 3/1958 | Gross | 271/277 X |
| 2,988,357 | 6/1961 | Ranger | 271/82 |
| 3,810,612 | 5/1974 | McCahon | 271/277 X |
| 4,132,403 | 1/1979 | Weisbach | 271/82 X |
| 4,210,079 | 7/1980 | Raes | 271/277 X |

FOREIGN PATENT DOCUMENTS 374968 3/1964 Switzerland .

*Primary Examiner*—Richard A. Schacher
*Attorney, Agent, or Firm*—Kontler, Grimes & Battersby

[57] ABSTRACT

A cylindrical drum of a rotary transfer conveyor rotates below an opening at the bottom of a magazine for a stack of superimposed sheets. The drum carries a first pivotable gripping lever and one or more second pivotable gripping levers. The common pivot axis of the levers is parallel to the axis of the drum, and the levers are pivotable by cams so that their speed relative to the magazine is less than the peripheral speed of the drum during travel immediately below the opening in the bottom of the magazine. At such time, a set of suction cups flexes a portion of the lowermost sheet of the stack through the opening and between the first and second gripping levers so that the speed of the engaged sheet need not be immediately accelerated to the peripheral speed of the drum but merely to the relatively low absolute speed of the levers. The levers extract the lowermost sheet from the magazine and simultaneously accelerate the extracted sheet to the peripheral speed of the drum prior to moving apart so that the sheet can descend by gravity. The levers subsequently return to positions below the opening in the bottom of the magazine to proceed with extraction of the next lowermost sheet.

15 Claims, 3 Drawing Figures

APPARATUS FOR SINGULARIZING STACKED SHEETS

CROSS-REFERENCE TO RELATED CASES

An apparatus for singularizing stacked sheets is disclosed in the commonly owned copending application Ser. No. 125,356 filed Feb. 28, 1980 by Hans Müller. Other singularizing apparatus are disclosed in the commonly owned U.S. Pat. Nos. 4,052,052, 4,808,678 and 4,085,927, all granted to Hans Müller.

BACKGROUND OF THE INVENTION

The present invention relates to apparatus for singularizing stacked sheets, i.e., for removing successive topmost, lowermost, foremost or rearmost sheets from a stack of flexible sheets wherein the sheets are disposed in vertical planes, in horizontal planes or in planes which are inclined with reference to a vertical as well as with reference to a horizontal plane.

It is already known to store a stack of superimposed or otherwise arrayed sheets in a magazine and to remove successive sheets of the stack, one by one, from the bottom, from the top, from the front side or from the rear side of the stack, depending on the orientation of the sheets which form the stack. Such apparatus are utilized in many types of bookbinding and like machines wherein successive folded or unfolded sheets must be delivered to a gathering or other processing station. As a rule, a singularizing apparatus comprises a flexing or bending device which can move a portion of the lowermost, foremost, uppermost or rearmost (i.e., outermost) sheet in a stack into the range of a rotary transfer conveyor. The latter comprises orbiting gripping means for releasably gripping the flexed portion of the outermost sheet and for extracting such sheet from the magazine wherein the stack is stored in response to further orbital movement of the gripping means about the axis of the transfer conveyor. Once a withdrawn sheet reaches a predetermined position, the gripping means is caused to open and to thus release the sheet which thereupon descends by gravity or is otherwise advanced toward and onto a stationary or mobile support, e.g., onto a conveyor which delivers the sheet to the next processing station. In many instances, the gripping means of the transfer conveyor comprises a gripping lever and a complementary gripping member or anvil, e.g., a cheek which can cooperate with the lever to grasp a flexed marginal portion (e.g., the folded back) of a sheet during extraction from the magazine.

As a rule, the aforementioned cheek is fixedly secured to the rotary components of the transfer conveyor which is driven at a constant peripheral speed. Therefore, when the gripping lever is caused to pinch a portion of the outermost sheet of a stack against the cheek, such sheet is abruptly accelerated from zero speed to the peripheral speed of the transfer conveyor. This is acceptable only if the peripheral speed of the transfer conveyor is relatively low and/or when the tensile strength of the material of which the sheets consist is extremely high so that the sheets can stand very pronounced stresses which develop abruptly whenever the lever begins to bias a portion of each of a series of successive outermost sheets against the cheek.

Swiss Pat. No. 374,968 discloses a singularizing apparatus wherein the speed of the transfer conveyor can be increased without necessarily damaging or destroying the sheets. The patented apparatus employs a drum which is driven by a planetary transmission and carries the cheek as well as the lever of the sheet gripping and extracting means. The planetary transmission reduces the peripheral speed of the drum to zero at the instant when the gripping lever begins to press a portion of the nearest outermost sheet against the cheek. The speed of the drum thereupon increases and such speed reaches a maximum value at the instant when the freshly extracted sheet is released, i.e., when the gripping lever moves away from the associated cheek. A drawback of the patented singularizing apparatus is that the transfer conveyor comprises a relatively large number of parts some of which are not only bulky but also heavy so that it is necessary to provide complex and expensive auxiliary equipment which compensates for the mass of the moving parts, i.e., which compensates for the fact that such heavy and bulky parts must be driven at a constantly varying speed, namely, between zero speed and a relatively high maximum speed. This contributes significantly to the initial and maintenance costs of the patented singularizing apparatus and renders the apparatus prone to malfunction. Another drawback of the patented apparatus is that, if its output is to be increased to a relatively high value which is often required in a modern gathering or like machine, the speed at which the sheets are discharged by the transfer conveyor is sufficiently high to entail at least some deformation of and/or other damage to the sheets as a result of impact against a further conveyor or against a stationary support.

OBJECTS AND SUMMARY OF THE INVENTION

An object of the invention is to provide a singularizing apparatus which can treat successive sheets of a stack gently even though the singularizing operation proceeds at a rate which at least matches and normally greatly exceeds that of fast or the fastest conventional singularizing apparatus.

Another object of the invention is to provide a singularizing apparatus whose output at least approximates, and may even exceed, twice the output of conventional apparatus.

A further object of the invention is to provide the apparatus with novel and improved means for regulating the speed of the sheet gripping and extracting components on the transfer conveyor.

An additional object of the invention is to provide the singularizing apparatus with a novel and improved transfer conveyor.

Still another object of the invention is to provide the singularizing apparatus with novel and improved means for transmitting motion to the constituents of the sheet gripping and extracting means in response to rotation of the transfer conveyor.

A further object of the invention is to provide a singularizing apparatus of the above outlined character which can be readily installed in many types of existing machines for the processing of folded or unfolded sheets, e.g., for gathering printed and folded sheets into signatures or other accumulations or arrays of identically dimensioned sheets.

An ancillary object of the invention is to provide the apparatus with a transfer conveyor which can move its sheet gripping and extracting means at a number of different speeds even though its drive transmits motion at a constant or nearly constant speed.

The improved apparatus is used to singularize stacked sheets and comprises a magazine or an analogous source of sheets arranged to store a stack which consists of overlapping sheets and includes an outermost sheet. A transfer conveyor s provided and includes rotary carrier means (e.g., a cylindrical drum which is rotatable about a horizontal axis), drive means (e.g., a horizontal shaft driven by an electric motor or another suitable prime mover) which is operable to rotate the carrier means in a predetermined direction and at a given (e.g., constant) peripheral speed, and first and second sheet gripping means movably mounted on and arranged to orbit about the axis of the carrier means in response to operation of the drive means whereby the gripping means travel along a predetermined path a first portion of which is adjacent to the outermost sheet of the stack in the magazine. The transfer conveyor further includes means for moving the gripping means relative to the carrier means so that the speed of the gripping means with reference to the sheets in the magazine varies between a lower first speed which is less than the peripheral speed of the carrier means and at which the gripping means move along the first portion of the path and a higher second speed. The apparatus further comprises one or more suction cups or other suitable means for introducing a portion of the outermost sheet of the stack in the magazine between the first and second gripping means during travel of the gripping means along the first portion of the path so that the gripping means engage and accelerate the thus inserted outermost sheet to the first speed and such sheet thereupon shares the movement of the gripping means relative to as well as with the carrier means. The moving means of the transfer conveyor is constructed and assembled to move (or to permit movement of) the gripping means apart to thus release the sheet which was gripped thereby in a second portion of the path downstream of the first portion, as considered in the direction of rotation of the carrier means.

The moving means preferably further includes means for biasing the first and second gripping means against the sheet portion between such gripping means during orbital movement of the gripping means between the first and second portions of the path. At least one of the gripping means is preferably movable with reference to the carrier means between first and second end positions, and the moving means maintains the one gripping means (e.g., a cheek which is movable outwardly and beyond the peripheral surface of the carrier means) in one of the two end positions during travel along the first portion of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
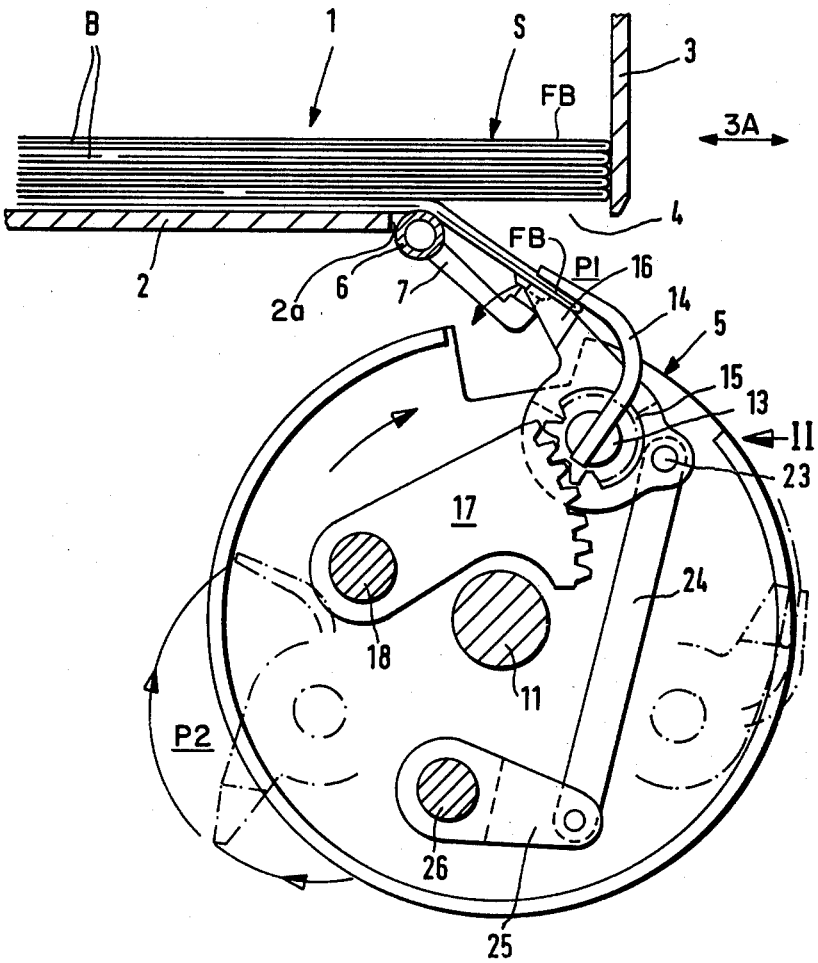
FIG. 1 is a schematic sectional view of a magazine for a stack of substantially horizontal sheets and a transverse vertical sectional view of a transfer conveyor which forms part of the improved apparatus, the sheet gripping and entraining means of the transfer conveyor being shown in the positions they assume immediately upon engagement with the folded back of the lowermost sheet of a stack in the magazine and the section of FIG. 1 being taken in the direction of arrows as seen from the line I—I of FIG. 2.
Figure 2:
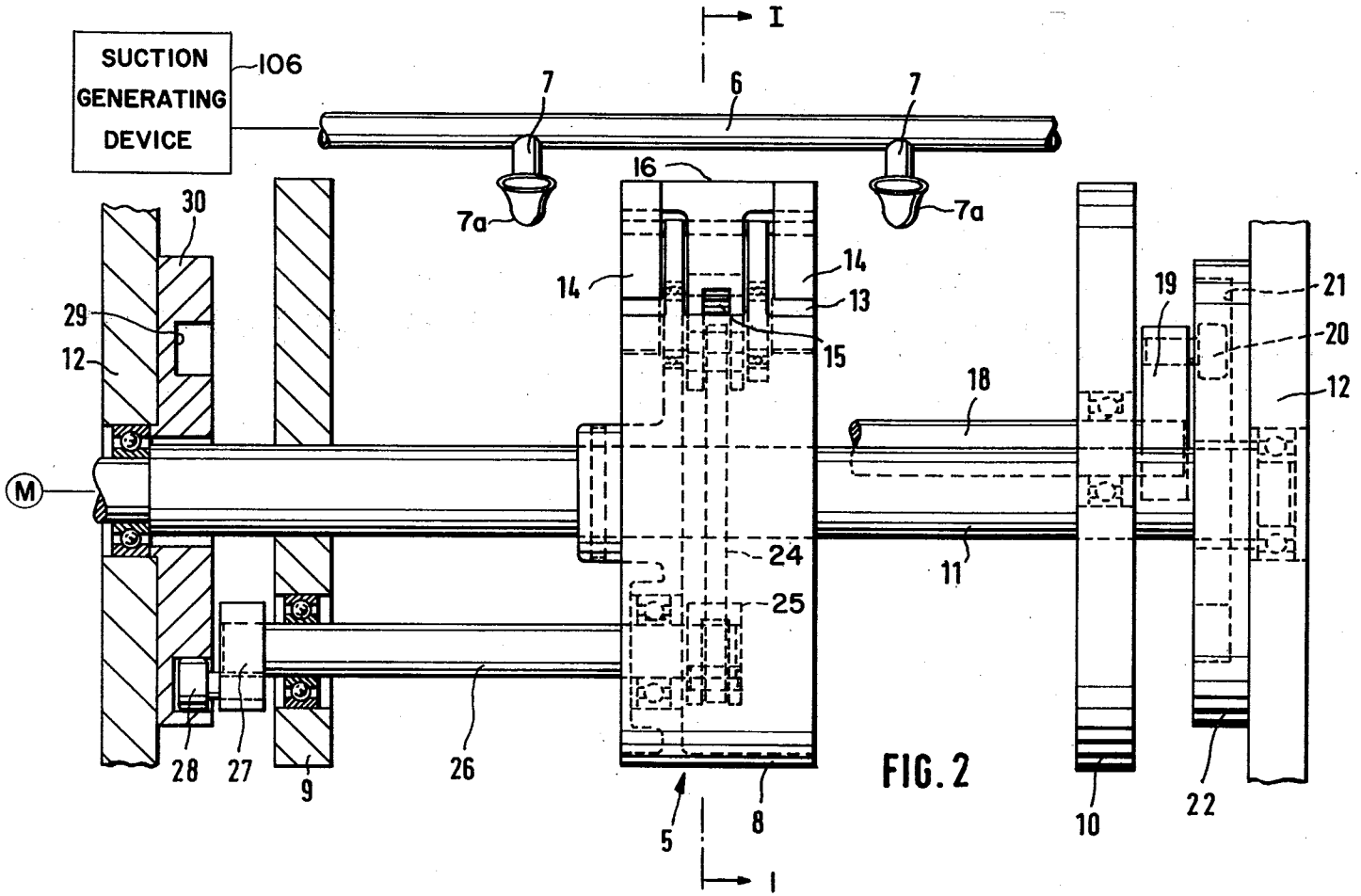
FIG. 2 is a partially plan and partially axial sectional view of the transfer conveyor, the plan view being taken in the direction of arrow II shown in FIG. 1.

The apparatus which is shown in FIGS. 1 and 2 comprises a magazine 1 including a horizontal first or bottom wall 2 and an upright second or side wall 3. The upper side of the bottom wall 2 supports a stack S of superimposed folded sheets B each of which has a portion here shown as a folded back FB which is adjacent to the inner side of the side wall 3. The bottom wall 2 extends short of the side wall 3 so that these walls define an opening 4 for withdrawal of successive lowermost (outermost) sheets B from the magazine 1. The side wall 3 can be shifted in the directions indicated by a double-headed arrow 3A so as to ensure that the folded backs FB of the sheets B which form the stack S are accurately aligned with each other.

The apparatus further comprises a transfer conveyor 5 which is disposed at a lever below the bottom wall 2 of the magazine 1 and serves to extract successive lowermost (outermost) sheets B from the space between the upper side of the bottom wall 2 and the next-to-the-lowermost sheet B of the stack S. Still further, the apparatus comprises a sheet flexing and introducing device which is installed between the opening 4 and the transfer conveyor 5 and serves to flex the folded backs FB of successive sheets B downwardly and through the opening 4 so that such folded backs can be engaged by the combined gripping and entraining means of the transfer conveyor. In the illustrated embodiment, the flexing and introducing device comprises a hollow horizontal shaft 6 which is adjacent to an edge face 2*a* of the bottom wall 2, i.e., to that edge face which flanks the adjacent portion of the opening 4. As shown in FIG. 2, the hollow shaft 6 is connected with several hollow arms 7 for suction cups 7*a* serving to adhere to the underside of the lowermost sheet B in the magazine 1 when the shaft 6 is rotated counterclockwise, as viewed in FIG. 1, so as to move the suction cups 7*a* to upper end positions immediately below the folded back FB of the lowermost sheet B in the magazine 1. The shaft 6 is rotated counterclockwise once during each revolution of the rotary transfer conveyor 5 so that the suction cups 7*a* attract the lowermost sheet B, whereupon the shaft 6 is rotated clockwise to the angular position of FIG. 1 (during the same revolution of the transfer conveyor 5) so as to move the folded back FB of the lowermost sheet B into the range of the aforementioned gripping and extracting means forming part of the transfer conveyor 5. The interior of the hollow shaft 6 communicates with the intake of a suction generating device 106, at least while the shaft 6 is caused to turn clockwise toward the position of FIG. 1, so as to ensure that suction in the cups 7*a* attracts the adjacent portion FB of the lowermost sheet B and that such portion is flexed downwardly and is introduced into the range of the gripping and entraining means of the transfer conveyor 5. The connection between the interior of the shaft 6 and the suction generating device 106 can be interrupted when the shaft reassumes the angular position of FIG. 1 as well as during counterclockwise rotation of the shaft 6 for the purpose of moving the suction cups *7a* against the underside of the lowermost sheet B in the magazine 1.

The transfer conveyor 5 comprises a centrally located drum-shaped rotary carrier 8 (see particularly FIG. 2) and two disc-shaped flanges 9, 10 which are disposed at the opposite sides of and are spaced apart from the respective end faces of the carrier 8. The flanges 9 and 10 have identical outer diameters and are coaxially secured to a drive shaft 11 which is freely rotatably journalled in the frame 12 of a sheet processing machine and can be driven by a suitable prime mover M, e.g., a variable-speed electric motor.

The drum-shaped carrier 8 of the transfer conveyor 5 supports a horizontal pivot member 13 which is parallel to the drive shaft 11 and is freely rotatable in the carrier. The pivot member 13 is rigidly connected with two gripping elements 14 in the form of substantially L-shaped levers (see particularly FIG. 1). The gripping elements 14 constitute one of the two sheet gripping means of the transfer conveyor 5 and are spaced apart from each other, as considered in the axial direction of the pivot member 13. The space between these gripping elements accommodates a gear 15 which shares all angular movements of the pivot member 13. A complementary gripping means here shown as a cheek 16 is mounted on the pivot member 13 and can cooperate with the gripping elements 14 to grip and temporarily hold the folded back FB of a sheet B. The cheek 16 resembles a lever and is free to turn with reference to the gear 15 and pivot member 13. When the cheek 16 travels below a sheet B whose folded back FB is attracted by the suction cups *7a* while the shaft 6 dwells in the angular position shown in FIG. 1, the gripping elements 14 are pivoted to engage the downwardly flexed folded back FB so that the folded back is positively engaged by the cheek 16 from below (as viewed in FIG. 1) and by the gripping elements 14 from above. As the carrier 8 continues to turn in a clockwise direction, as viewed in FIG. 1, the cheek 16 cooperates with the two gripping elements 14 to extract the lowermost sheet B from the magazine 1 via opening 4. The gripping elements 14 are pivoted by the gear 15 which is in mesh with a second gear here shown as a gear segment 17 mounted on a horizontal shaft 18 extending between the flange 10 and the member 8. The gear segment 17 is affixed to the shaft 18 which is free to rotate in the carrier 8 and flange 10 of the transfer conveyor 5. The right-hand end portion of the shaft 18, as viewed in FIG. 2, carries an arm 19 for a roller follower 20 which extends into the suitably configurated endless groove 21 of face cam 22. The latter is fixedly mounted in the frame 12.

The cheek 16 carries a pivot pin 23 for one end portion of a connecting rod or link 24 the other end portion of which is articulately connected with a lever 25. The latter is fixedly secured to a control shaft 26 which is rotatable in the carrier 8 and in the flange 9 of the transfer conveyor 5. The control shaft 26 receives motion from a stationary cam 30 which is fixedly mounted in the frame 12 and has an endless cam groove 29 for a roller follower 28 secured to the free end of an arm 27 which is affixed to the shaft 26. When the drive shaft 11 rotates, it transmits torque to the drum-shaped carrier 8 and to the flanges 9, 10 of the transfer conveyor 5. This causes the roller followers 20 and 28 to travel in the respective cam grooves 21 and 29 to thereby respectively rock the gripping elements 14 and the control shaft 26 (i.e., the lever 25 which, in turn, rocks the cheek 16 via connecting rod 24).

Figure 3:
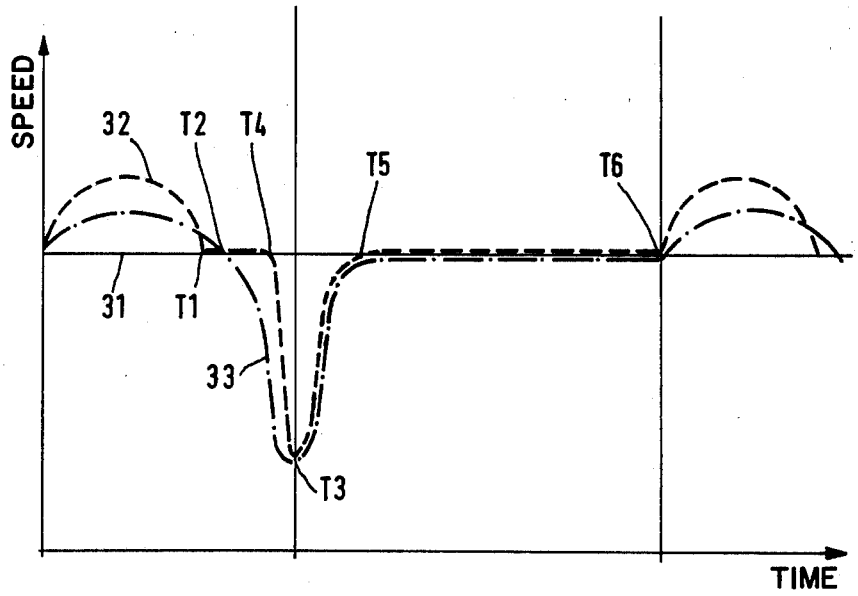
FIG. 3 is a time-velocity diagram showing the speeds of the sheet gripping and extracting means in different angular positions of the transfer conveyor.

The configuration of the cam grooves 29 and 21 is such that the cheek 16 and the gripping elements 14 respectively perform movements in a sequence and at varying speeds as represented in the diagram of FIG. 3. The straight horizontal solid line 31 denotes the constant (given) peripheral speed of the flanges 9, 10 and drum-shaped carrier 8 of the transfer conveyor 5. The broken line 32 represents the movements of the gripping elements 14, and the phantom line 33 represents the movements of the cheek 16.

The operation is as follows:

During the first stage of a revolution of the transfer conveyor 5, the cheek 16 and the gripping elements 14 are pivoted to first or foremost end positions (relative to the carrier 8 as viewed in the direction of rotation of the drive shaft 11) which these parts respectively assume at the instants T2 and T1 shown in the diagram of FIG. 3. At the instant T2, the cheek 16 begins to approach the downwardly flexed folded back FB of the lowermost sheet B in the stack S, that is, begins to move from its foremost or first end position toward its rearmost or second end position (again considered relative to the carrier 8). The speed of the cheek 16 relative to the flanges 9, 10 and member 8 reaches a maximum value at the instant T3; at the same time, the (absolute) speed of the cheek 16 relative to the lowermost sheet B of the stack S is reduced to a minimum value. At such instant (T3), the cheek 16 comes in contact with the downwardly flexed folded back FB of the lowermost sheet B the major part of which is still confined in the magazine 1. Shortly prior to the instant T3 (as indicated at T4 in the diagram of FIG. 3), the gripping elements 14 begin to approach their rearmost or second end positions so that they engage the cheek 16 (and more particularly the folded back FB of the lowermost sheet B) at the instant T3 to thereupon cooperate with the cheek 16 in extracting the lowermost sheet B from the magazine 1 because the drive shaft 11 continues to rotate the carrier 8 and the flanges 9, 10 of the transfer conveyor 5 in a clockwise direction, as viewed in FIG. 1. As they grip and entrain the lowermost sheet B of the stack S, the cheek 16 and the gripping elements 14 continue to move toward their respective rearmost positions, and such positions are reached at the instant T5. During the interval between the instants T3 and T5, the lowermost sheet B of the stack S is accelerated to the peripheral speed of the flanges 9, 10 and drum-shaped carrier 8. The thus accelerated (formerly) lowermost sheet B is released by the parts 14, 16 at the instant T6 and is dropped onto a suitable support, not shown. The releasing operation takes place as a result of pivoting of the cheek 16 and gripping elements 14 to their foremost or first end positions. The just described singularizing operation is then repeated, i.e., the parts 14, 16 of the orbiting gripping means thereupon begin to perform movements preparatory to extraction of the next-following lowermost sheet B from the stack S.

The diagram of FIG. 3 further shows that the absolute speed of both the gripping means including the cheek 16 and the gripping means including the elements 14 is reduced to a mininum value in that portion of the path of orbital movement of such gripping means about the shaft 11 which is nearest to the folded back FB of the lowermost sheet B of the stack S in the magazine 1. In other words, the speed of movement of the gripping means 16 and 14, 14 along the just mentioned path with reference to the magazine 1 is less than the peripheral speed (line 31) of the drum-shaped carrier 8 when the suction cups *7a* introduce the folded back FB of the lowermost sheet B in the stack S between the gripping means 16 and 14, 14 at the instant T3, i.e., in that (first) portion of the path of the gripping means which is nearest or at least close to the opening 4 in the bottom of the magazine 1. This means that the lowermost sheet B is accelerated first to a relatively low speed the speed of the gripping means 16 and 14, 14 at the instant T3) which is less than the peripheral speed (line 31) of the carrier 8 and flanges 9, 10. The thus introduced lowermost sheet is thereupon accelerated further during travel toward and into a second portion of the path of the gripping means, namely, into that portion which is located downstream of the portion nearest to the opening 4 (as considered in the direction of rotation of the carrier 8) and wherein the means for moving the gripping means 16 and 14, 14 relative to the carrier 8 moves the two gripping means apart so that the sheet B is allowed to descend by gravity onto a suitable support or the like. During travel from the first toward the second portion of the path of orbital movement of the two gripping means about the shaft 11, the sheet B which is being extracted from the magazine 1 contacts the peripheral surfaces of the carrier 8 and flanges 9, 10.

Those arms of the levers 14 which bear against the respective side of the folded back FB of a sheet B which is being entrained by the two gripping means may consist of elastic material so that they are biased against the folded back FB and thereby press the latter against the gripping means or cheek 16. FIG. 1 shows that the cheek 16 extends outwardly and beyond the peripheral surface of the carrier 8 during travel along that portion of its path which is nearest to the opening 4, and that the cheek 16 thereupon moves radially inwardly so that its outer (sheet-contacting side is disposed in the region of the peripheral surface of the carrier 8 (or even within the confines of the carrier) until the two gripping means are caused to move apart in the aforementioned second portion of the path in order to release the sheet whose folded back FB is held between the cheek 16 and the levers 14. The first portion of the path is indicated at P1, and the second portion of the path is indicated at P2.

The aforediscussed elasticity of the sheet-engaging arms of the levers 14 is not absolutely necessary, i.e., the moving means (including the cams 22, 30, the roller followers 20, 28, the arms 19, 27, the shafts 18, 26 and the motion transmitting means 17, 15 and 25, 24, 23) for the gripping means 16 and 14, 14 can be designed in such a way that the sheet-engaging arms of the levers 14 are maintained sufficiently close to the sheet-engaging side of the cheek 16 during travel from the path portion P1 toward the path portion P2 to ensure that the folded back FB of the sheet B which is being extracted from the magazine 1 is held with a requisite force so that such sheet cannot become disengaged from the orbiting gripping means. All that counts is to ensure that the moving means for the gripping means moves the levers 14 sufficiently close to the cheek 16 at the instant T3 that the cheek 16 can cooperate with the levers 14 to entrain the lowermost sheet B of the stack S in the magazine 1 until the gripping means reach the path portion P2 (instant T6) where the sheet is allowed to become disengaged from the gripping means, i.e., where the moving means moves the gripping means apart so that the sheet (which by then is fully extracted from the magazine 1) is allowed to descend or to be taken over by other advancing, conveying or like devices, not shown, for example, by a means for spreading or opening up the sheet if the latter is a folded sheet of the type shown in FIG. 1.

The speed at which the gripping means move with the sheet which is held thereby matches or approximates the peripheral speed of the carrier 8 between the instants T5 and T6. The speed of the gripping means thereupon exceeds the peripheral speed of the carrier 8 for a certain interval of time (between the instant T6 and the respective instant T1 and T2), and the absolute speed of the gripping means is then rapidly reduced to much less than the peripheral speed of the carrier 8 between the instants T2 and T3 (as concerns the cheek 16) and between the instants T4 and T3 (as concerns the gripping elements or levers 14). All this can be readily seen by referring to the diagram of FIG. 3. In other words, the gripping means 16 and 14, 14 travel (at a relatively high speed) counter to the direction of rotation of the carrier 8 during advancement along those portions of their path which precede the portion P1, i.e., the velocity of the gripping means during engagement with the folded back FB of a sheet is relatively low so that the initial acceleration of such sheet takes place relatively gradually from zero speed (in the magazine 1) to the instantaneous speed of the gripping means instead of relatively abruptly from zero speed to the higher peripheral speed of the carrier 8 and flanges 9, 10. It can be said that the speed of the cheek 16 relative to the carrier 8 is maximal shortly before the cheek 16 is brought into contact with the folded back FB of the lowermost or outermost sheet B in the magazine 1. Whether or not the speed of the cheek 16 (and also of the levers 14) in a clockwise direction, as viewed in FIG. 1, is thereupon rapidly increased to match the peripheral speed of the carrier 8 depends on the design of the grooves 21 and 29 in the cams 22 and 30. The cheek 16 is held in one of its end positions with reference to the carrier 8 when it comes into contact with the folded back FB of a fresh sheet B in the path portion P1, and the cheek 16 can reach the other end position with reference to the carrier 8 during travel along the portion P2 of its path of orbital movement about the shaft 11. It is preferred to design the moving means for the cheek 16 and levers 14 in such a way that the sheet B which is engaged by the gripping means in the path portion P1 is immediately accelerated to the speed of travel of the gripping means about the shaft 11 and then gradually accelerated to the peripheral speed of the carrier 8 and flanges 9, 10 no later than when the sheet is released in the path portion P2.

An important advantage of the improved apparatus is that the mass of the parts which move relative to the flanges 9, 10 and drum-shaped carrier 8 of the transfer conveyor 5 during each revolution of the drive shaft 11 is relatively small so that the transfer conveyor can be driven at a very high peripheral speed without resort to complex auxiliary equipment for counteracting the effects of imbalance. In spite of the high peripheral speed of the rotary parts 8, 9 and 10 of the transfer conveyor 5, successive sheets B can be gradually accelerated to and maintained at such peripheral speed during transport by the transfer conveyor. Still further, the apparatus is capable of discharging successive extracted sheets at a speed which is not so high that the discharged sheets would be likely to become defaced or damaged as a result of pronounced impact against the support which receives singularized sheets from the transfer conveyor 5. The output of the improved apparatus can exceed the output of presently known singularizing apparatus by at least 100 percent.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for feeding sheets comprising:

(a) a magazine for confining a stack of sheets;

(b) rotary carrier means for transferring sheets from said magazine to a location spaced from the same;

(c) drive means for said carrier means;

(d) first gripping means mounted on said carrier means for rotation therewith and for movement relative thereto;

(e) first moving means for moving said first gripping means relative to said carrier means in response to rotation of the latter such that the speed of said first gripping means relative to said magazine varies between a lower value in the region of said magazine and a higher value remote from said magazine, said first moving means including a stationary first cam, a first shaft coupled to said first gripping means and mounted on said carrier means so as to project from the latter towards said first cam, and a first follower on said shaft tracking said first cam;

(f) second gripping means mounted on said carrier means for rotation therewith and for movement relative thereto, said second gripping means being arranged to cooperate with said first gripping means to grip a sheet during transfer of the same from said magazine to said location;

(g) second moving means for moving said second gripping means relative to said carrier means in response to rotation of the latter such that the speed of said second gripping means relative to said magazine varies between a lower value in the region of said magazine and a higher value remote from said magazine, said second moving means including a stationary second cam, a second shaft coupled to said second gripping means and mounted on said carrier means so as to project from the latter towards said second cam, and a second follower on said second shaft tracking said second cam, said first and second moving means also being arranged to move said first and second gripping means together in the region of said magazine so as to grip a sheet to be transferred and to move said first and second gripping means apart in the region of said location so as to release the sheet; and (h) introducing means for introducing sheets from said magazine to said first and second gripping means.

2. The apparatus of claim 1, wherein said moving means include means for biasing said first and second gripping means against a sheet therebetween.

3. The apparatus of claim 1, wherein at least one of said gripping means is movable with reference to said carrier means between first and second end positions and the respective moving means is arranged to maintain said one gripping means in one of said end positions during travel adjacent said magazine.

4. The apparatus of claim 3, wherein said carrier means has a peripheral surface and said one gripping means is adjacent to said peripheral surface in the other of said end positions, said one gripping means extending outwardly of and beyond said peripheral surface in said one end position thereof.

5. The apparatus of claim 4, wherein said moving means include pivot means mounted in and having an axis parallel to the axis of said carrier means, said one gripping means being rockable back and forth about the axis of said pivot means in predetermined angular positions of said carrier means, and the other of said gripping means being also movable about the axis of said pivot means.

6. The apparatus of claim 5, wherein said moving means is arranged to rock said other gripping means about the axis of said pivot means.

7. The apparatus of claim 1, wherein at least one of said gripping means moves counter to said carrier means during movement to said one gripping means adjacent said magazine.

8. The apparatus of claim 1, wherein at least one of said gripping means includes at least one lever which is pivotable with reference to said carrier means.

9. The apparatus of claim 1, wherein said carrier means has a substantially cylindrical peripheral surface contacted by a sheet which is held by said gripping means.

10. The apparatus of claim 1, wherein said magazine has a bottom wall supporting the stack therein, and an opening adjacent to said bottom wall, the outermost sheet of the stack in said magazine resting on said bottom wall and having a portion overlying said opening, said introducing means including means for flexing such portion outwardly.

11. The apparatus of claim 1, comprising two disc-shaped flanges coaxial with and flanking said carrier means, said flanges having peripheral surfaces in contact with a sheet which is held by said gripping means.

12. The apparatus of claim 1, wherein said first cam is arranged to cause said first gripping means to move towards and away from said second gripping means in the respective regions of said magazine and said location, and said second cam is arranged to cause said second gripping means to move towards and away from said first gripping means in the respective regions of said magazine and said location.

13. The apparatus of claim 1, wherein said first and second cams are located on opposite sides of said carrier means.

14. The apparatus of claim 1, said first moving means including an additional shaft which is rotatably mounted on said carrier means and extends substantially parallel to the axis of rotation thereof, said additional shaft being spaced from said first and second shafts; and wherein said first gripping means is mounted on said additional shaft for rotation therewith and said second gripping means is mounted on said additional shaft for rotation relative thereto, said first moving means comprising first coupling means connecting said additional shaft with said first shaft and said second moving means comprising second coupling means connecting said second gripping means with said second shaft.

15. The apparatus of claim 1, wherein said first and second shafts are rotatably mounted on said carrier means.

* * * * *